US005632448A

United States Patent [19]

Alexander et al.

[11] Patent Number: 5,632,448

[45] Date of Patent: May 27, 1997

[54] ROTARY POWDER APPLICATOR

[75] Inventors: Kevin L. Alexander; Wade H. Hickam, both of Brownsburg; Chris M. Jamison, Indianapolis; Michael C. Rodgers, Greensburg, all of Ind.

[73] Assignee: Ransburg Corporation, Indianapolis, Ind.

[21] Appl. No.: 377,816

[22] Filed: Jan. 25, 1995

[51] Int. Cl.[6] ..... B05B 5/04

[52] U.S. Cl. ..... 239/703; 239/704

[58] Field of Search ..... 239/700, 701, 239/703, 704, 708, 690

[56] References Cited

U.S. PATENT DOCUMENTS

| | | | |
|---|---|---|---|
| 2,728,607 | 12/1955 | Smart . | |
| 3,263,127 | 7/1966 | Point et al. . | |
| 3,536,514 | 10/1970 | LaFave et al. . | |
| 4,037,561 | 7/1977 | LaFave et al. . | |
| 4,114,564 | 9/1978 | Probst . | |
| 4,776,520 | 10/1988 | Merritt | 239/700 |
| 5,353,995 | 10/1994 | Chabert | 239/701 |
| 5,433,387 | 7/1995 | Howe et al. | 239/690 X |

OTHER PUBLICATIONS

Aerobell™ & Aerobell Plus™ Rotary Atomizers, DeVilbiss Ransburg Industrial Liquid Systems, 1992.

*Primary Examiner*—Josie Ballato

*Attorney, Agent, or Firm*—Barnes & Thornburg

[57] ABSTRACT

A system for atomizing and dispensing powder comprises a fluidized powder bed for entraining the powder fluidized in a bearing air stream, a dispenser, and a motor for rotating the dispenser. The dispenser has a somewhat bell-shaped interior. The motor has an output shaft having a first passageway extending lengthwise thereof. A feed tube extends through the first passageway. The fluidized powder is fed to an end of the feed tube passageway remote from the dispenser to be supplied through the feed tube to the interior as the motor rotates the dispenser. A diffuser is mounted within the interior. A discharge slot is defined between the dispenser and an edge of the diffuser. The feed tube is mounted so that it does not rotate with the output shaft. The diffuser includes a back side facing the interior and bounded by the edge. The back side includes a generally part-spherical concavity into which the fluidized powder is directed from the feed tube.

7 Claims, 5 Drawing Sheets

ROTARY POWDER APPLICATOR

BACKGROUND OF THE INVENTION

1. Field of the Invention

This invention relates to atomizers, and particularly to an improved atomizer for atomizing and dispensing fluidized pulverulent coating material particles, hereinafter generally referred to as powder.

2. Description of Related Art

Rotary atomizers for atomizing and dispensing powder borne in a bearing fluid stream, for example, a compressed air stream, are known. There are, for example, the atomizers of U.S. Pat. Nos.: 3,263,127; 3,356,514; 4,037,561 and, 4,114,564. In these references, the compressed air stream containing fluidized powder is supplied through the center of the motor shaft on the opposite end of which a somewhat cup- or bell-shaped rotary powder stream atomizer is mounted. The connection of the shaft to the bearing fluid stream source, for example, a fluidized bed, is a rotary connection. This requires that a rotary seal be effected and maintained between the conduit which supplies the stream bearing the powder and the motor shaft. Any compromise in the seal between these two results in leakage of the typically highly penetrating, abrasive powder. This can result in leakage of the powder into the motor, with its attendant consequences both in abrasion and contamination of motor components. There are also the teachings of U.S. Pat. Nos. 2,728,607 and 5,353,995.

SUMMARY OF THE INVENTION

It is an object of the present invention to alleviate this problem by employing a construction which does not require a rotary seal to be made between the conduit which extends from the powder bearing stream source, typically a fluidized bed, and the feed passageway which extends through the rotator motor shaft.

The invention is disclosed in the context of a modified DeVilbiss Ransburg AEROBELL™ liquid rotary atomizer available from ITW Automotive Division, 8227 Northwest Boulevard, Suite 230, Indianapolis, Ind. 46278.

According to the invention, an apparatus for atomizing and dispensing pulverulent material comprises a dispenser, and a motor for rotating the dispenser. The motor has an output shaft. The dispenser is mounted on the output shaft to be rotated thereby. The dispenser has a somewhat bell-shaped interior. The output shaft has a passageway extending lengthwise thereof. Pulverulent material entrained in a bearing fluid is fed to an end of the passageway remote from the dispenser to be supplied through the passageway to the interior as the motor rotates the dispenser. A diffuser is mounted at an end of the passageway within the interior. A discharge slot is defined between the dispenser and an edge of the diffuser. The diffuser has a back side facing the interior and bounded by the edge. The back side includes a concavity into which the entrained pulverulent material is directed from the passageway.

According to illustrative embodiments, the concavity is generally part-spherical in configuration.

Further according to illustrative embodiments, the means for mounting the diffuser at the end of the passageway within the interior comprises means for mounting the diffuser for rotation with the dispenser.

Additionally according to illustrative embodiments, the diffuser is mounted by threaded fastening means. Spacing means and openings are provided in the diffuser and in the interior for receiving the threaded fastening means. The threaded fastening means extends through the openings in one of the diffuser and interior, then through the spacing means and then through the openings in the other of the diffuser and interior to mount the diffuser with the edge in spaced relation to the dispenser.

According to illustrative embodiments, the dispenser further comprises an exterior, and a discharge edge extending between the interior and exterior. The exterior of the dispenser comprises an electrically non-insulative coating.

Further according to an illustrative embodiment, the bearing fluid-entrained pulverulent material is fed to an end of the passageway remote from the dispenser to be supplied through the passageway to the interior via a feed tube extending through the passageway and providing a second passageway. The bearing fluid-entrained pulverulent material is fed to an end of the second passageway remote from the dispenser. The feed tube is so mounted that it does not rotate with the output shaft.

BRIEF DESCRIPTION OF THE DRAWINGS

The invention may best be understood by referring to the following description and accompanying drawings which illustrate the invention. In the drawings.

DETAILED DESCRIPTION OF AN ILLUSTRATIVE EMBODIMENT

Figures 1, 2, 3:
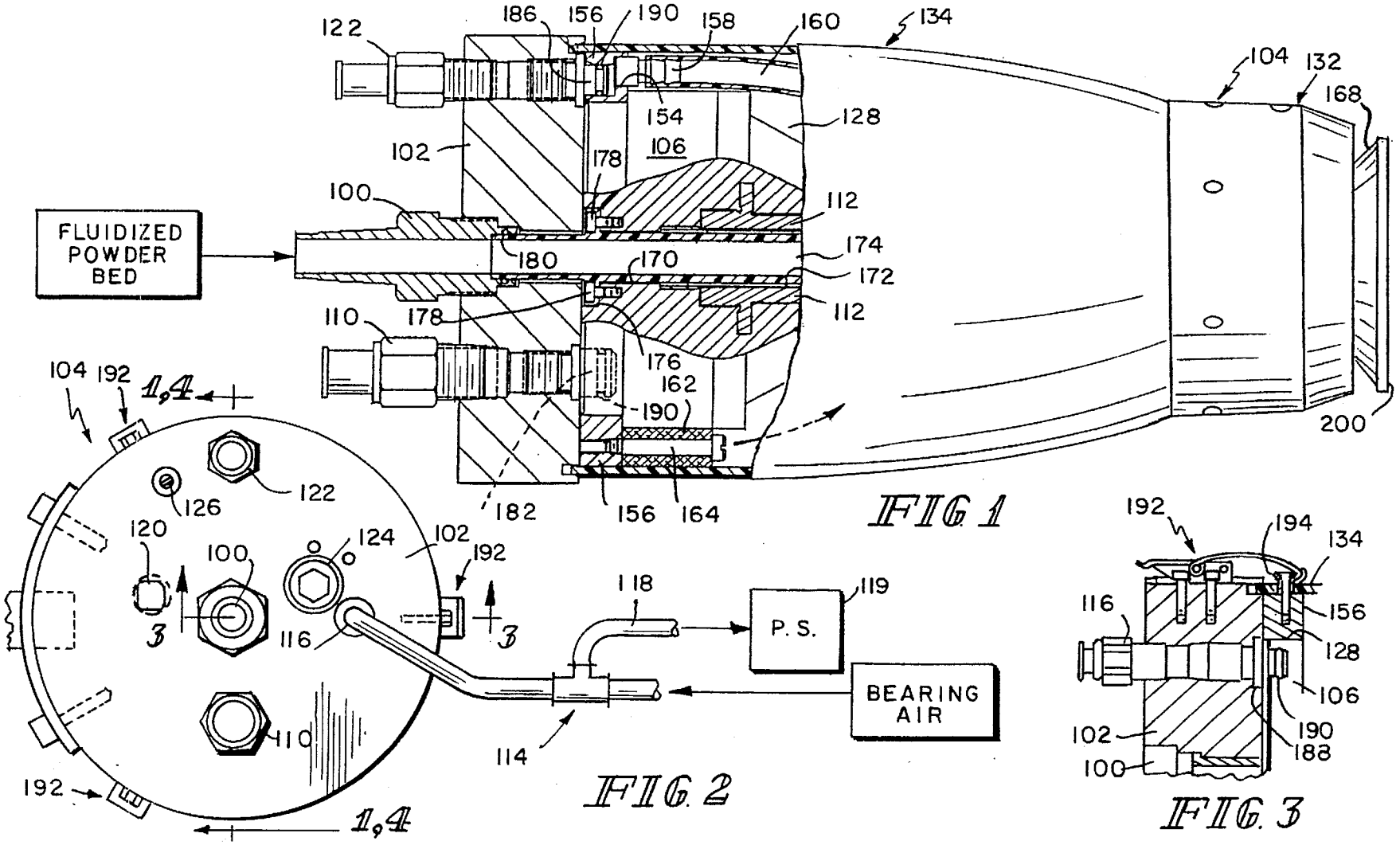
FIG. 1 illustrates a partly broken away side elevational view of a rotator constructed according to the present invention.
FIG. 2 illustrates a rear elevational view of the rotator of FIG. 1.
FIG. 3 illustrates an enlarged, fragmentary sectional view, taken generally along section lines 3—3, of FIG. 2.
Figure 4:
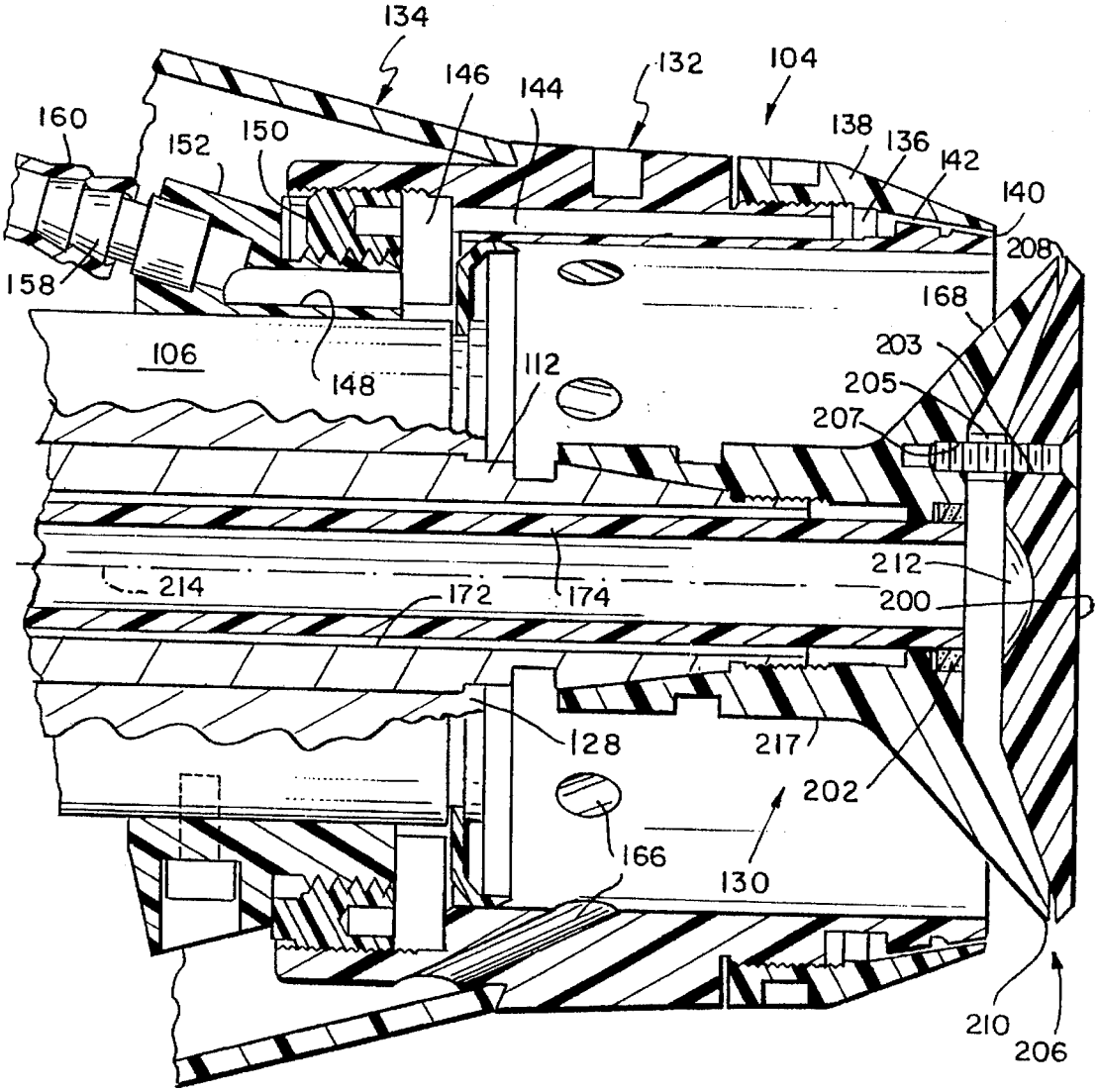
FIG. 4 illustrates an enlarged, fragmentary, longitudinal sectional view, taken generally along section lines 4—4 of FIG. 2.
Figure 5:
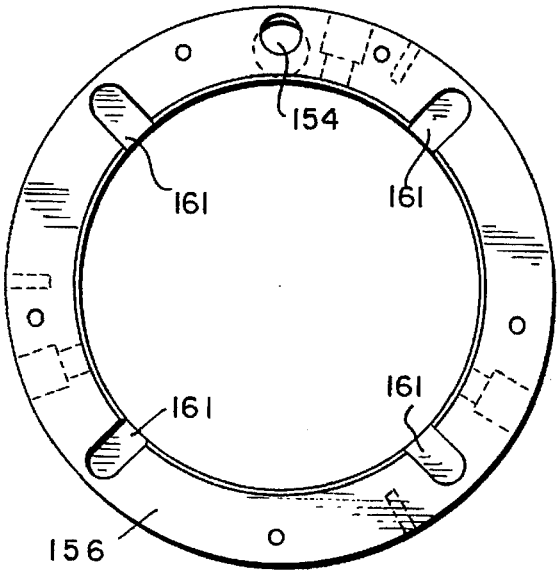
FIG. 5 illustrates a front elevational view of a detail of FIG. 1.
Figure 6:
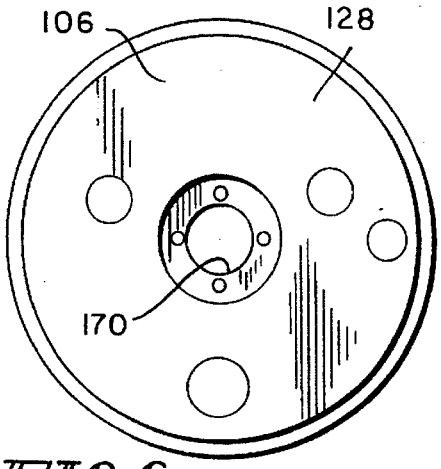
FIG. 6 illustrates a rear elevational view of a detail of FIG. 1.
Figure 8:
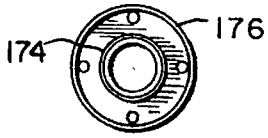
FIG. 8 illustrates an end view of the detail of FIG. 7, taken generally along section lines 8—8 thereof.
Figure 7:
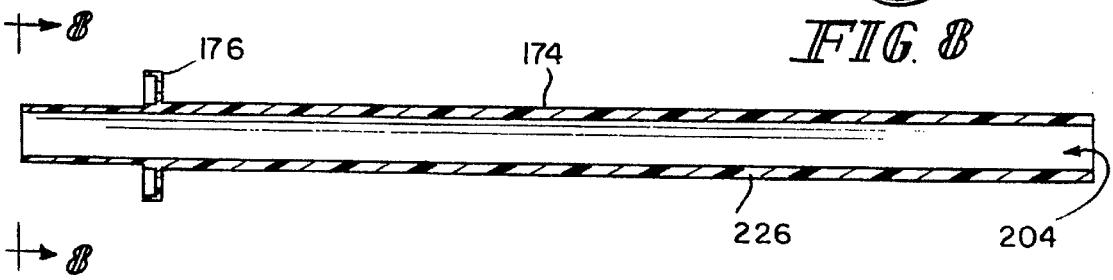
FIG. 7 illustrates a longitudinal sectional view of a detail illustrated in FIG. 4.
Figure 9:
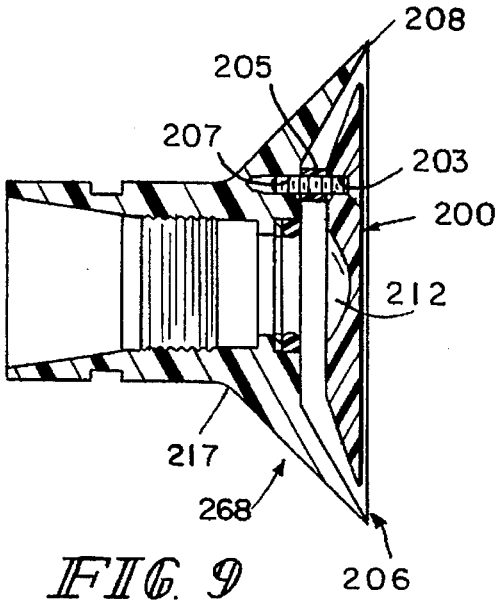
FIGS. 9–13 illustrate enlarged, longitudinal sectional views of alternative details to a detail illustrated in FIG. 4; and, FIG. 14 illustrates a fragmentary end elevational view, taken generally along section lines 14—14, of a detail of FIG. 13.
Figure 10:
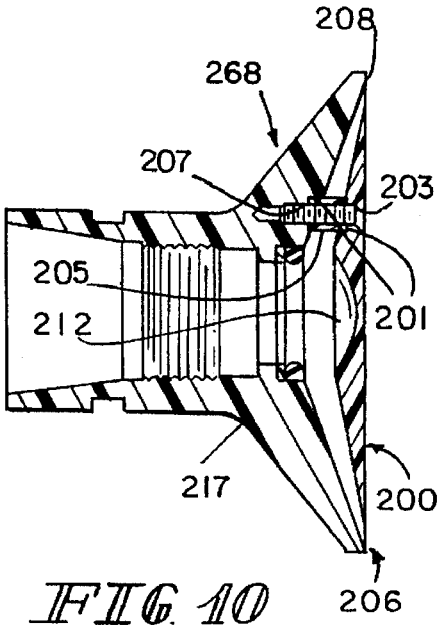
Figure 11:
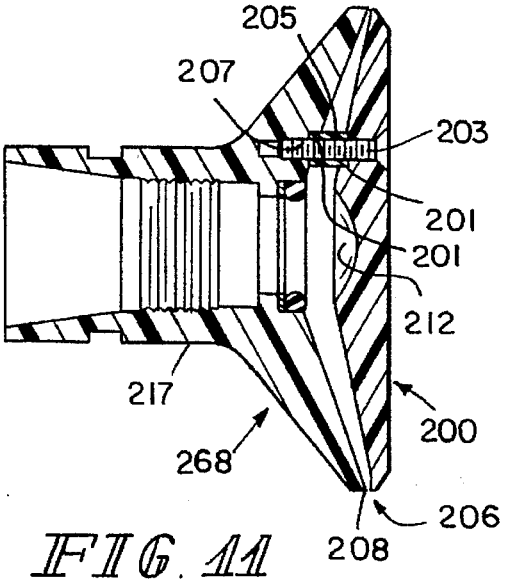

Referring now particularly to FIGS. 1–7, powder in a powder-bearing air stream is supplied through a barbed resin, for example, Delrin, fitting 100 to the manifold 102 of a rotary atomizer 104. Manifold 102 illustratively is constructed from aluminum alloy or some other metal. Drive air for a turbine 106 is supplied through a barbed turbine air fitting 110 on manifold 102. Turbine 106 illustratively is an air bearing turbine, the shaft 112 of which is supported during operation on an air cushion in an air bearing (not shown) of the type available from Westwind Air Bearings, Inc., 745 Phoenix Drive, Ann Arbor, Mich. 48108. The bearing air for the air bearing is provided through a T coupler 114 (FIG. 2) and a male connector 116 to manifold 102. The other outlet 118 of T coupler 114 is coupled to a pressure switch 119. In the event flow to the bearing air male connector 116 is interrupted, this interruption is sensed by the pressure switch 119, and the turbine drive air flow to fitting 110 and the powder flow to fitting 100 are interrupted to try to spare the turbine 106.

Braking air to retard the rotation of turbine 106 is coupled through a fitting 120 to manifold 102. Shaping air for shaping the cloud of atomized powder produced by atomizer 104 is provided to a shaping air fitting 122. A fiber optic speed transducer 124, such as the DeVilbiss Ransburg type SMC-29 inductive-to-fiber optic transmitter, monitors turbine 106 speed and feeds speed-related information back to a controller (not shown) by which closed loop control of the air supplies to fittings 110, 120 is achieved. A suitable high voltage connector 126 and high voltage cable (not shown) couple manifold 102, and thus, the electrically conductive housing 128 of turbine 106 to a suitable high voltage source such as, for example, a DeVilbiss Ransburg EPS 554 power supply.

The output end 130 (FIG. 4) of shaft 112 extends from housing 128 and out through a, for example, Delrin, shaping air ring 132. Shaping air ring 132 is mounted on the front end of a, for example, Delrin or high density polyethylene, shroud 134. A shaping air gallery 136 provided around the circumference of shaping air ring 132 is closed by a, for example, Delrin, shaping air cap 138 except for a slot-like shaping air opening 140. Radially inwardly extending grooves 142 on ring 132 provide air flow between ring 132 and cap 138, resulting in a uniform width opening 140 and uniform air flow to shape the atomized powder cloud. Shaping air is provided to gallery 136 through intersecting passageways 144, 146, 148. Passageways 144, 146 and 148 are provided in and between shaping air ring 132, a, for example, Delrin, shaping air ring adaptor 150, and a, for example, aluminum alloy, shaping air manifold 152. Shaping air is provided to shaping air manifold 152 from fitting 122 through manifold 102, a shaping air passageway 154 (FIGS. 1 and 5) provided in a turbine mounting ring 156, barbed fittings 158 on mounting ring 156 and shaping air manifold 152, and a length of tubing 160 extending between fittings 158. Mounting ring 156 illustratively is formed from aluminum alloy. Fittings 158 illustratively are brass fittings. Tubing 160 illustratively is polyethylene tubing.

Spent turbine 106 drive air is exhausted from turbine 106 through exhaust ports lying radially inward from turbine mounting ring 156 and elbow-shaped reliefs 161 (FIG. 5) formed in turbine mounting ring 156 forward through a felt muffler strip 162 (FIG. 1) which is secured to turbine mounting ring 156 by threaded fasteners 164. This spent turbine drive air flows forward inside shroud 134 and is exhausted through exhaust passageways 166 in shaping air ring 132 and outward around the powder bell 168 fixed to the output end 130 of shaft 112. This exhaust air aids the shaping air flowing from slot opening 140 to form an envelope confining the cloud of atomized powder flowing from the inside of powder bell 168. Turbine 106 braking air supplied through fitting 120 to the turbine is exhausted through the same pathway.

The turbine housing 128 and shaft 112 are provided with central passageways 170, 172, respectively, both of which are accessible through powder fitting 100. A, for example, stainless steel or Delrin, powder feed tube 174 having a somewhat cup-shaped, radially and circumferentially extending flange 176 extends through passageways 170, 172 and an aligned opening in manifold 102 and into sealing engagement with fitting 100. An 0-ring 180 between tube 174 and fitting 100 secures this seal. Cap screws 178 through aligned holes in flange 176 and turbine housing 128 secure powder feed tube 174 to housing 128 and space the outer circumference of tube 174 uniformly from the wall of the central passageway 172 of shaft 112. Fittings 182, 184, 186, 188 on the turbine 106 side of manifold 102 are provided with 0-ring seals 190 which seal mating passageways in the turbine mounting ring 156 and turbine housing 128 for the supply of turbine air, braking air, shaping air and turbine shaft bearing air, respectively. These fittings are all maintained in sealed orientation by three equally circumferentially spaced leaf spring draw latches 192 mounted on manifold 102 which engage respective equally circumferentially spaced keeper buttons 194 mounted through shroud 134 to turbine mounting ring 156. This configuration permits the turbine 106, shroud 134 and associated components to be removed from the manifold 102 and its associated components for maintenance and the like.

Turning now to the bell 168 and its associated powder diffusing baffle 200, the bell 168 is provided with internal threads which engage external threads on the output end 130 of shaft 112 to mount the bell 168 thereon. Bell 168 is thereby mounted for rotation with shaft 112. Diffuser 200 is mounted on powder bell 168 and, as a result, rotates with it. The diffuser 200 is attached to the powder bell 168 by threaded fasteners which extend through three equally circumferentially spaced countersunk holes 203 in the diffuser 200, through right circular cylindrical spacers 205 and into three circumferentially equally spaced threaded holes 207 in the front, or inside, face of powder bell 168. Depending upon the profiles of the back surface 210 of the diffuser and facing front surface of the bell, reliefs 201 or lands may have to be molded, machined or otherwise formed in/on these surfaces to provide seats for the spacers 205. The spacers 205 are of sufficient length to provide a circumferential, slot-shaped opening 206 between the discharge edge 208 of bell 168 and the back surface 210 of diffuser 200. The spacers 205 illustratively are formed from polyetheretherketone. The outside surface 217 of bell 168 between the shaft 112 and discharge edge 208 is coated with a conductive coating such as Tube Koat coating available from G.C. Electronics Division of Hydrometals, Inc., Rockford, Ill. 61101 to aid in the charging of the powder as the powder is dispensed through slot 206.

Figure 12:
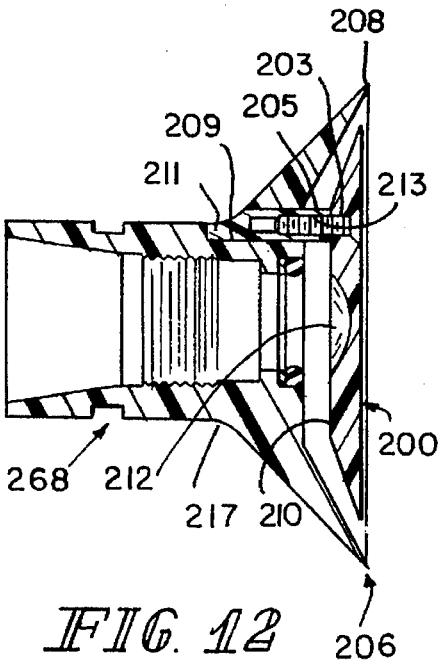

Other mounting configurations for the diffuser are of course possible. In FIG. 12, for example, the bell is provided with three equally circumferentially spaced holes 209 into which inserts 211 having threaded holes 213 are press-fitted. Inserts 211 illustratively are formed from nylon filled with 15% glass fiber and 30% carbon fiber to render the inserts electrically more conductive. The outside surface 217 of the bell in FIG. 12 between the shaft 112 and inserts 211 is coated with a conductive coating of the type previously identified to aid in the charging of the powder as the powder is dispensed through slot 206. The insides of the spacers 205 and the back, or inside, surface 210 of the diffuser 200 is also coated with such a material. Because of the relatively low rotation frequency, on the order of 4000 rpm or so, of bell 168, sealing between bell 168 and the adjacent surface of powder feed tube 174 is achieved with a, for example, felt or polytetrafluorethylene seal ring 202. This prevents powder dispensed from powder feed tube 174 from migrating backward through the space between passageway 172 and the powder feed tube 174 outer wall into the turbine 106. The spacers 205 are of sufficient length to provide a circumferential, slot-shaped opening 206 between the discharge edge 208 of bell 168 and the back surface 210 of diffuser 200.

Figure 13:
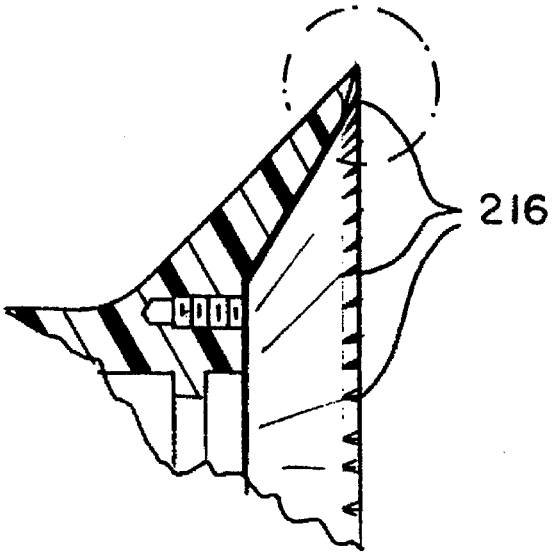
Figure 14:
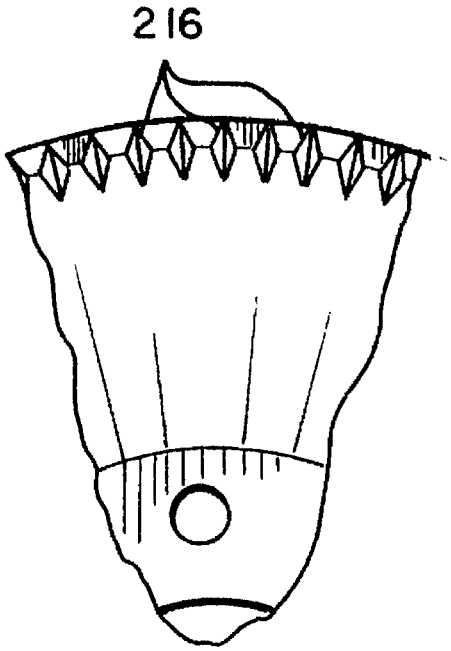

Several different configurations of the bell and diffuser are possible. Some of these are illustrated in FIGS. 4 and 9–14. In each, the fluidized powder which is fed along tube 174 exits from tube 174 through its outer end 204 and is directed onto the back surface 210 of diffuser 200, and then outwardly through the slot 206. Each illustrated diffuser is provided with a part spherical concavity 212 on its back surface 210. The concavity is coaxial with the axis 214 of feed tube 174. The turbulence created by the impingement of the fluidized powder exiting outer end 204 upon concavity 212 reduces the likelihood of impact fusion of the fluidized powder on the surface 210 and promotes the migration of the fluidized powder from slot 206 to form the dispensed powder cloud. The edge of the bell can be provided with serrations 216, as illustrated in FIGS. 13–14, to aid in the uniform distribution of the powder throughout the powder cloud.

What is claimed is:

1. An apparatus for dispensing pulverulent coating material entrained in a stream of a bearing gas, the apparatus comprising a dispenser, a motor for rotating the dispenser, the motor having an output shaft, the dispenser being mounted on the output shaft to be rotated thereby, the dispenser having a somewhat bell-shaped interior, the output shaft having a passageway extending lengthwise thereof, means for feeding the pulverulent coating material entrained in bearing gas to an end of the passageway remote from the dispenser to be supplied through the passageway to the interior as the motor rotates the dispenser, a diffuser and means for mounting the diffuser at an end of the passageway within the interior, an annular discharge slot being defined between the dispenser and an edge of the diffuser, the diffuser having a back side facing the interior and bounded by the edge, the back side including a concavity into which the entrained pulverulent coating material is directed from the passageway.

2. The apparatus of claim 1 wherein the concavity is generally part-spherical in configuration.

3. The apparatus of claim 1 or 2 wherein the means for mounting the diffuser at the end of the passageway within the interior comprises means for mounting the diffuser for rotation with the dispenser.

4. The apparatus of claim 3 wherein the means for mounting the diffuser comprises threaded fastening means, and spacing means and openings in the diffuser and in the interior for receiving the threaded fastening means, the threaded fastening means extending through the openings in one of the diffuser and interior, then through the spacing means and then through the openings in the other of the diffuser and interior to mount the diffuser with the edge in spaced relation to the dispenser.

5. The apparatus of claim 1 wherein the dispenser further comprises an exterior, and a discharge edge extending between the interior and exterior, the exterior of the dispenser comprising an electrically non-insulative coating.

6. The apparatus of claim 5 wherein the means for mounting the diffuser at the end of the passageway within the interior comprises means for mounting the diffuser for rotation with the dispenser.

7. The apparatus of claim 1 wherein the means for feeding the bearing gas-entrained pulverulent material to an end of the passageway remote from the dispenser to be supplied through the passageway to the interior comprises a feed tube extending through the passageway and providing a second passageway, means for feeding the bearing gas-entrained pulverulent material to an end of the second passageway remote from the dispenser, and means for mounting the feed tube so that it does not rotate with the output shaft.

* * * * *